US005868490A

United States Patent [19]

Barthelmess

[11] Patent Number: 5,868,490

[45] Date of Patent: Feb. 9, 1999

[54] DECORATIVE LIGHTING SYSTEM IN CLUSTER ARRANGEMENT

[75] Inventor: Peter Barthelmess, New Hempstead, N.Y.

[73] Assignee: Barcana, Inc., New City, N.Y.

[21] Appl. No.: 643,698

[22] Filed: May 6, 1996

[51] Int. Cl.[6] ..... F21P 1/02

[52] U.S. Cl. ..... 362/252; 362/227; 362/363; 362/391; 362/407; 362/806

[58] Field of Search ..... 362/226, 249, 362/252, 363, 806, 234, 227, 391, 407; D26/80, 86

[56] References Cited

U.S. PATENT DOCUMENTS

| | | | |
|---|---|---|---|
| 638,895 | 12/1899 | Wallis | 362/252 |
| 2,101,898 | 12/1937 | Crosser | 362/249 |
| 3,253,137 | 5/1966 | Richter, III | 362/249 |
| 4,591,959 | 5/1986 | Kenyon | 362/252 |
| 5,245,519 | 9/1993 | Openiano | 362/252 |
| 5,517,394 | 5/1996 | Lin | 362/806 |

*Primary Examiner*—Alan Cariaso
*Attorney, Agent, or Firm*—Richard B. Klar, Esq.

[57] ABSTRACT

The present invention relates to a decorative lighting system arranged in a bunched or clustered fashion. The system includes a lighting string having wired branches of various lengths, small light bulbs fixed to these branches, colored globes with the sleeve shaped openings and connecting members connecting the light bulbs inside of the globes. This decorative ornament includes a sleeve or cup for looping the lighting string therein and an elastic loop of material threaded and connected through and an opening in the sleeve from which the ornament can be hung.

16 Claims, 5 Drawing Sheets

DECORATIVE LIGHTING SYSTEM IN CLUSTER ARRANGEMENT

BACKGROUND OF THE INVENTION

1. The Field of the Invention

The present application relates to a decorative lighting system arranged in a grouped, bunched or clustered fashion. This clustered arrangement can be used for both indoor and outdoor use, but is primarily intended for indoor use. The system includes a lighting string formed of a series of small light bulbs strung on wiring; colored housings or globes with openings, preferably sleeve-shaped openings; and connecting members. Each of the light bulbs on the lighting string is inserted into one of the connecting members which in turn, can be inserted into an opening in one of the housings or lighting globes. Further, the lighting string is configured to provide a clustered or bunched look such as a bunch of grapes. This decorative ornament can be hung from a ceiling or from any other appropriate location.

2. The Prior Art

Lighting systems are known in the prior art. However, it would be advantageous to provide a clustered arrangement of globe-shaped bulbs in which the lighting string is arranged so that the bulbs hang at different heights to provide a clustered look. It would be advantageous to use such a cluster-shape lighting arrangement system to decorate an indoor area and to decorate other objects, or to hang from ceilings, or shelves or for hanging on a hook of a wall.

SUMMARY OF THE INVENTION

It is a principle object of the invention to provide a decorative lighting system with a clustered arrangement which is easy to assemble, colorful, and which holds light bulbs of a lighting string and provides a clustered look.

Further objects will become more readily apparent in the description drawings provided.

DETAILED DESCRIPTION OF THE PREFERRED EMBODIMENTS

Figure 1:
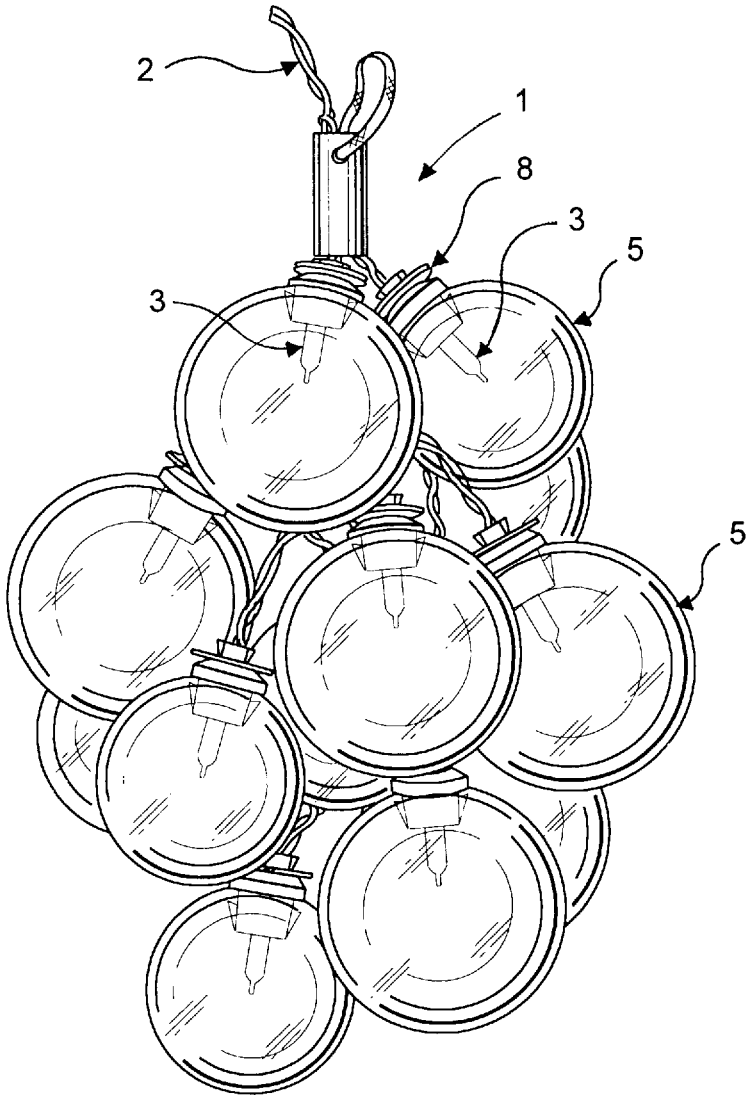
FIG. 1 is a front elevational view showing the embodiment of the invention, fully assembled, in a clustered arrangement.

Referring now to the drawings, in particular FIGS. 1–8, FIG. 1 shows the present invention in its completed state wherein a lighting string 2 is shown which contains a plurality of lighting bulbs with lighting string 2 arranged in a clustered arrangement for hanging.

Figure 2:
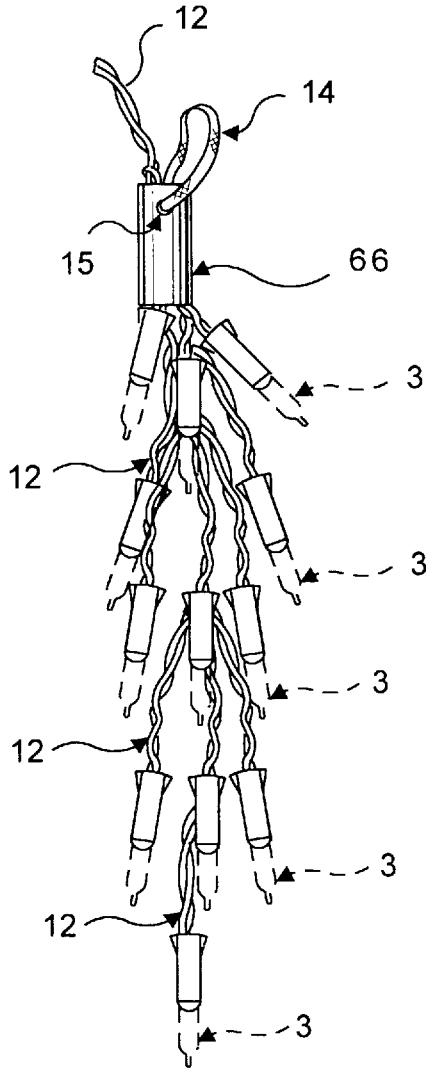
FIG. 2 is the clustered embodiment shown in FIG. 1 without the globes attached.
Figure 8:
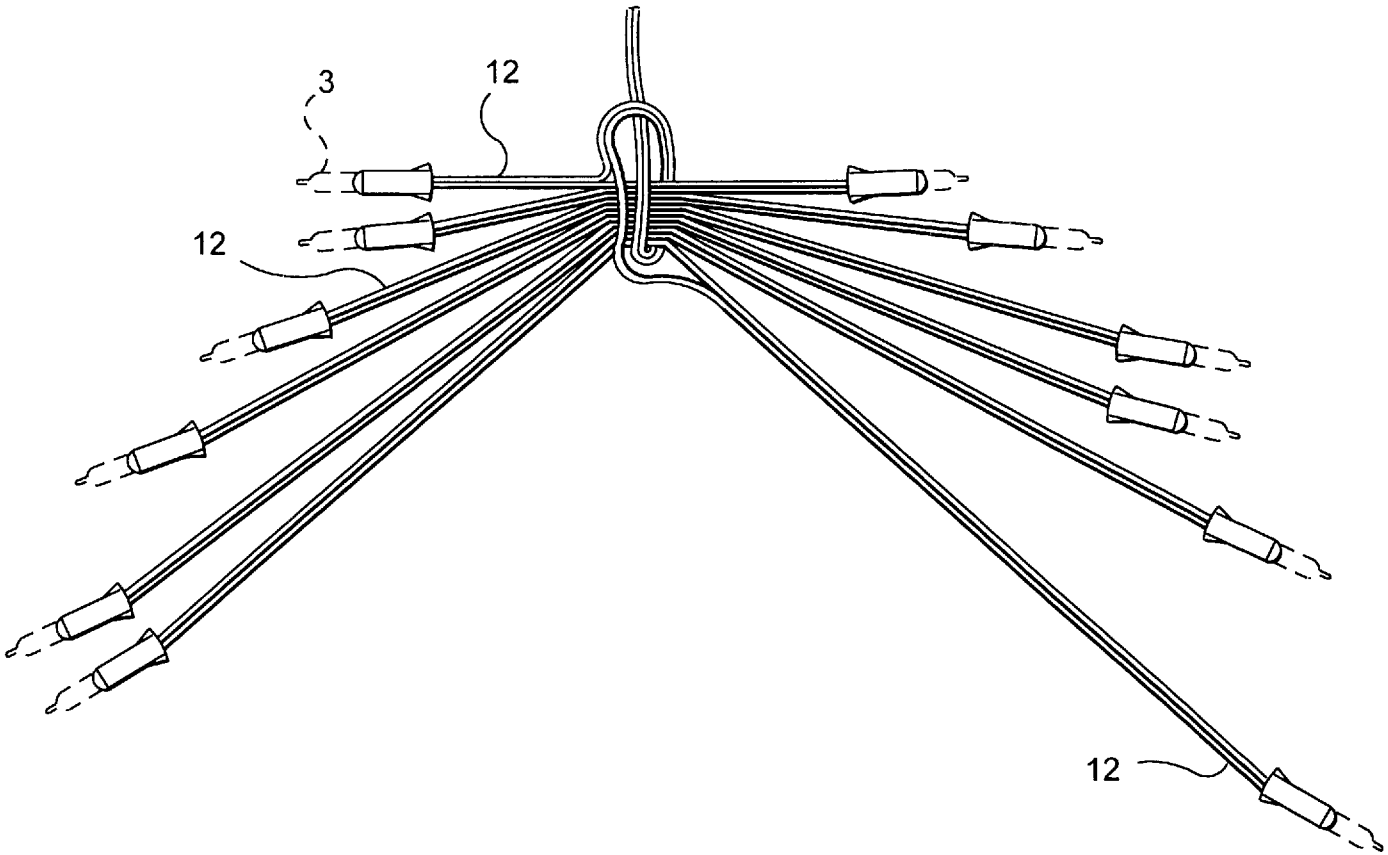
FIG. 8 shows the string curled without the globes.

As shown in FIG. 2, which illustrates the present invention in a partially uncompleted state, the lighting string 2 includes a plurality of light bulbs 3 with the lighting string 2 being arranged in a clustered arrangement so that some light bulbs 3 are suspended at a higher distance than other light bulbs 3 thus providing for this clustered, or multi-tiered arrangement of light bulbs 3 when the invention 1 is hung or suspended as shown in FIG. 1. The lighting string 2 includes a plurality of branches 12 of different lengths to create this clustered effect when the lighting string is looped as shown in FIG. 8 and in FIGS. 1 and 2. When the globes 5 are connected to the light bulbs 3 by the connecting members, then the arrangement looks as shown in FIG. 1. The lighting string 2 itself is looped or coiled together with a portion of it looped or curled within the cylindrical shaped sleeve 66 as shown in FIGS. 1 and 2. In addition, a piece of looping material 14, preferably elastic, such a string or cord is threaded through a hole 15 in the sleeve 6 so that the clustered lighting string 2 can be hung to provide a decorative look. It is understood that the present invention is not limited to any one geometric arrangement or to any particular number of light bulbs or globes or sizes for any of the components.

Figure 3:
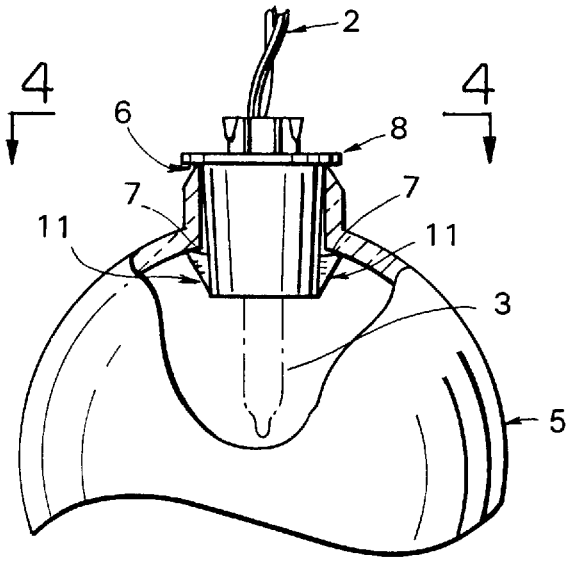
FIG. 3 is a partial sectional view of one of the globes with one of the light bulb of the lighting string connected thereto by a connecting member.
Figure 4:
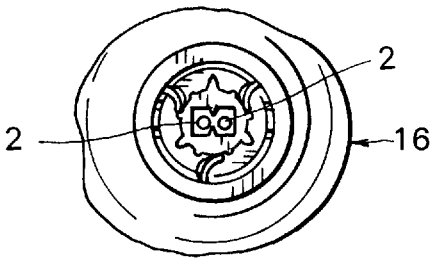
FIG. 4 is a top surface view taken along lines 4—4 of FIG. 3 of one of the light bulbs of the lighting string showing where the wires are to be attached.

FIG. 3 shows one of the globes 5 with one of the light bulbs inserted therein and connected thereto by means of a connecting member 8. FIG. 4 shows the portion along lines 4—4 of FIG. 3 of the socket in which the one of the light bulbs of the lighting string is inserted. As can be seen, the wires are attached to the contact points 15 of the socket 16 as shown in FIG. 4.

Figure 5:
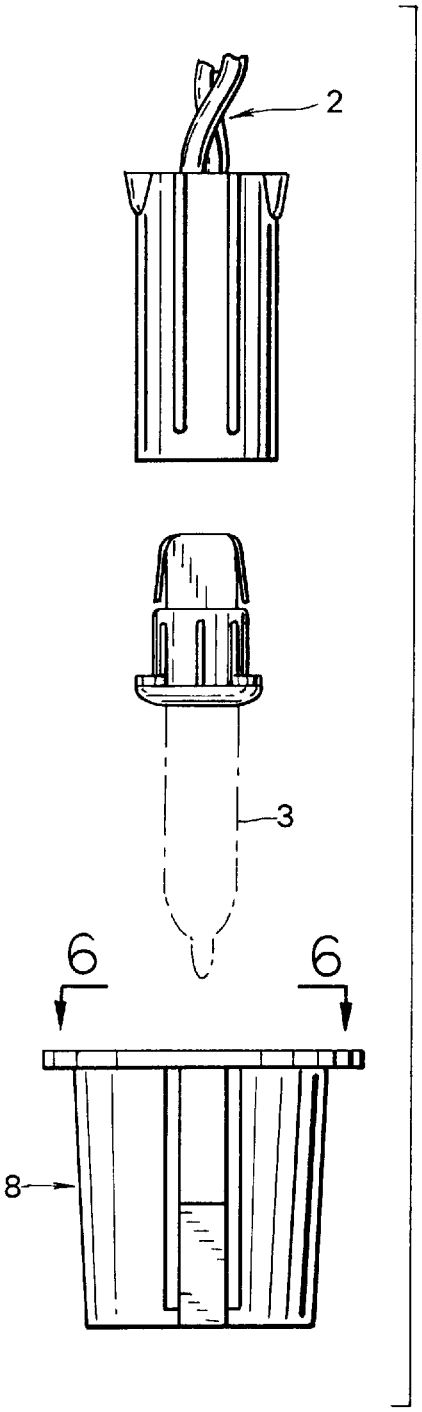
FIG. 5 is a partially exploded view showing the insertions of one end of the light bulb of the lighting string into its socket and the other end of the light bulb into one of the connecting members.

FIG. 5 shows a partially exploded view of the showing the connecting member, a light bulb 3 with a lighting string 2 and the socket 16.

Figure 6:
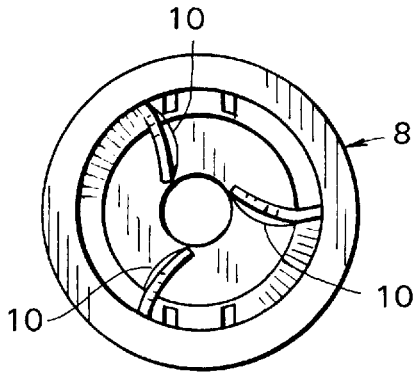
FIG. 6 is a top view along the lines of 6—6 of FIG. 5 showing one of the surfaces of the connecting members.

A top view of the connecting member 8 is shown in FIG. 6 showing engaging rib members 10 for holding the light bulb securely in place. In addition, rib members 10 can be on the connecting member to engage the inner lips of the opening 6 of the globes 5. The lighting string 2 itself can be made to accommodate any size light bulbs 3 and is depicted to show an arrangement of 12 light bulbs and globes. These can be seen in the uncoiled state of the lighting string 2 in FIG. 7. Three light bulbs 3 are arranged at the same length, two are at another length slightly further down and hanging arrangement from the first set of three and another set of three slightly further down from the preceding set of two. In addition, another set of three is shown suspended further down from the preceding set of three and finally a single bulb suspended at the lowest level on the lighting string 2.

FIG. 8 shows the same arrangement of bulbs 3 with the lighting string 2 partially coiled up to show how they are arranged when the globes 5 are connected thereto by means of each of their respective connecting members 8.

The globes 5 are preferably made of plastic materials and are spherically shaped. They have an opening 6 at one end with an internal lip 7 as described above for engaging connecting with the connecting member 8 in order to provide a means for fastening the connecting member 8 to the globe 5 and in turn permitting the light bulb 3 of the lighting string 2 to be fittingly connected within the globe 5.

The connecting member is preferably made by injection molding in one piece, and of plastic material. They preferably have internal rib members 10. The connecting member 8 also has preferably two external rib like members 11 for engaging the internal lip 7 of the sleeve shaped opening 6 of the globe 5.

The lighting strings were custom made for the applicant by Philitalia Lighting Company, Inc. and were made to the following specifications, although the number of bulbs and the particular lengths of the wires can be changed and adjusted and the invention is not limited to any specific dimensions or quantities of light bulbs and globes. The lighting string 2 was made with 12 bulbs and globes were connected thereto by respective connecting members. The lighting string 2 was made with a first set of wires having a length of one inch, and a set of three and a second set of wires suspended 2.75 inches, a set of two, a third set of wires of three bulbs with length of four inches in a set of three, a fourth length of wires, three bulbs a length of 5'5 inches, and a fifth set of bulbs one length of 8 inches.

Figure 7:
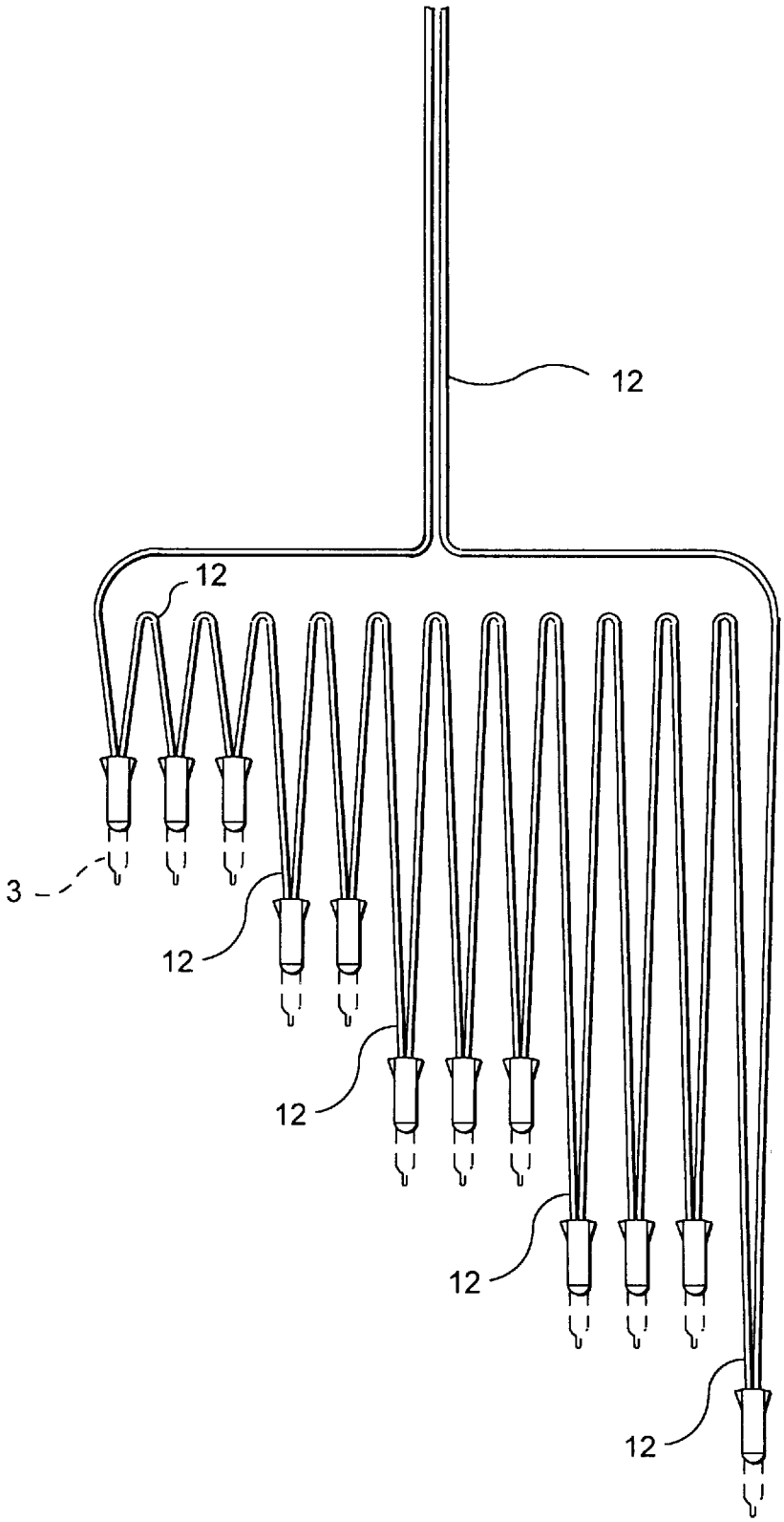
FIG. 7 is the lighting string of the cluster arrangement uncurled showing the light bulbs at different lengths.

In addition, in FIG. 7 there are two long wires extending from one bulb on one end and a bulb from the 8" length which feeds back into the plug. These wires are coiled together to obtain the arrangement shown in FIG. 8 and, in particular, the portion of the lighting string that runs back toward the plug is housed in a plastic cup or sleeve, and the wires at the end that extend outside of the sleeve are connected to a plug for insertion to an outlet, the wire can be a 60 inch lead in wire to the outlet is preferable. In addition, a loop such as an elastic cord can be utilized and used for hanging onto a wall or suspended from a ceiling or anywhere else where appropriate.

Thus the clustered decorative lighting arrangement can be used to decorate ceilings and other objects.

I do not limit myself to any particular details of constructive supports in the specification illustrated in the accompanying drawings, the same refers to and sets forth only sectional of the embodiments of the invention, and observed the same may be modified without departing from the spirit of the scope of the claimed invention.

I claim:

1. A decorative lighting system, comprising:

a lighting string having a number of branches of wiring of various lengths, said branches of various lengths being fixed relative to one another at a common point, said branches include three branches of a first length, two branches of a second length which is longer than said first length, three branches of a third length which is longer than said second length, three branches of a fourth length which is longer than said third length, and one branch of a fifth length which is longer than said fourth length, and further comprising a plurality of light bulbs secured to said branches of said lighting string;

a plurality of housings, each having an opening; and connecting members having means for engagingly inserting said light bulbs into said openings of said housings.

2. The system according to claim 1 wherein said means for said connecting members include a number of external rib members for each engaging the respective opening of each housing and a number of internal rib members for engagingly securing each of the respective light bulbs.

3. The system according to claim 1 wherein said housings are formed as globes.

4. The system according to claim 1 wherein said lighting string is looped to form a clustered arrangement.

5. The system according to claim 4 wherein said system further includes a sleeve for housing a portion of said looped lighting string.

6. The system according to claim 5 wherein said clustered arrangement resembles a bunch of grapes.

7. The system according to claim 5 further including a loop of material connected to said sleeve from which said system can be hung.

8. The system according to claim 7, wherein said loop of material is elastic.

9. The system according to claim 5 wherein said sleeve is made of plastic material.

10. A decorative lighting system, comprising:

a lighting string having branches of wiring of various lengths, said branches of various lengths being fixed relative to one another at a common point, a plurality of light bulbs secured to said branches of said lighting string wherein said branches include at least one branch of a first length and at least one branch of a second length where said second length is longer than said first length; said at least one branch of a first length include three branches of said first length, and said at least one branch of a second length includes two branches of said second length which is longer than said first length, and said branches further include three branches of a third length which is longer than said second length, three branches of a fourth length which is longer than said third length, and one branch of a fifth length which is longer than said fourth length, and further comprising;

a plurality of housings, each having an opening;

connecting members having means for engagingly inserting said light bulbs into said openings of said housings; and said lighting string is looped to form a clustered arrangement of said branches, said light bulbs and said housings.

11. The system according to claim 10 wherein said system further includes a sleeve for housing a portion of said looped lighting string.

12. The system according to claim 10 wherein said clustered arrangement resembles a bunch of grapes.

13. The system according to claim 10 wherein said housings are formed as globes.

14. The system according to claim 11 further including a loop of material connected to said sleeve from which said system can be hung.

15. The system according to claim 14, wherein said loop of material is elastic.

16. The system according to claim 11 wherein said sleeve is made of plastic material.

* * * * *